US007310911B1

(12) United States Patent
Sellman

(10) Patent No.: US 7,310,911 B1
(45) **Date of Patent: *Dec. 25, 2007**

(54) AUTOMATIC DOOR OPENER WITH MAGNETIC CLUTCH

(75) Inventor: Nils D. Sellman, Simsbury, CT (US)

(73) Assignee: Power Access Corporation, New Hartford, CT (US)

( * ) Notice: Subject to any disclaimer, the term of this patent is extended or adjusted under 35 U.S.C. 154(b) by 216 days.

This patent is subject to a terminal disclaimer.

(21) Appl. No.: 10/464,695

(22) Filed: Jun. 18, 2003

Related U.S. Application Data

(63) Continuation-in-part of application No. 09/952,225, filed on Sep. 13, 2001, now Pat. No. 6,634,140.

(60) Provisional application No. 60/232,296, filed on Sep. 13, 2000.

(51) Int. Cl.
*E05F 11/24* (2006.01)

(52) U.S. Cl. ..... 49/340; 192/18 B; 192/90

(58) Field of Classification Search ..... 49/333, 49/334, 335, 337, 339, 340; 192/18 B, 90
See application file for complete search history.

(56) References Cited

U.S. PATENT DOCUMENTS

| | | | | |
|---|---|---|---|---|
| 2,701,036 A | * | 2/1955 | Osborne | 188/171 |
| 3,059,485 A | | 10/1962 | Bohlman et al. | 74/95 |
| 3,272,290 A | * | 9/1966 | Goddard | 192/18 B |
| 3,609,390 A | | 9/1971 | Feldman | 307/134 |
| 3,719,005 A | | 3/1973 | Carli | 49/28 |
| 3,874,117 A | | 4/1975 | Boehm | 49/264 |
| 3,955,661 A | | 5/1976 | Popper et al. | 192/150 |
| 4,289,995 A | | 9/1981 | Sorber et al. | 318/9 |
| 4,334,161 A | | 6/1982 | Carli | 310/68 E |
| 4,342,354 A | | 8/1982 | Leivenzon et al. | 160/133 |
| 4,472,910 A | | 9/1984 | Iha | 49/139 |
| 4,644,693 A | | 2/1987 | Wang | 49/280 |
| 4,836,345 A | | 6/1989 | Anderson | 192/20 |
| 4,852,706 A | | 8/1989 | Pietrzak et al. | 192/8 R |
| 4,945,678 A | | 8/1990 | Berner et al. | 49/322 |
| 5,018,304 A | | 5/1991 | Longoria | 49/340 |
| 5,222,327 A | | 6/1993 | Fellows et al. | 49/139 |
| 5,698,073 A | | 12/1997 | Vincenzi | 160/188 |

(Continued)

FOREIGN PATENT DOCUMENTS

| | | |
|---|---|---|
| EP | 0 2172228 | 9/1986 |

(Continued)

*Primary Examiner*—Jerry Redman
(74) *Attorney, Agent, or Firm*—Cantor Colburn LLP

(57) ABSTRACT

An automatic door opener (10) for opening or closing a door (28) includes a motor (14) driving a drive shaft (50) and an opener arm (18) connected to the door (28) and being responsive to rotation of the drive shaft (50) for moving the door (28) to an open or closed position. A clutch (46) operable to disengage the drive shaft (50) from the opener arm (18) is provided in the event of the door (28) engaging an obstacle, electric power being unavailable, or the door being fully open or fully closed. The door opener (10) may also include a brake (48) for selectively preventing movement of the door (28). Various embodiments of the invention are provided, including an electromagnet (80) and an electromagnetic brake (114).

5 Claims, 8 Drawing Sheets

U.S. PATENT DOCUMENTS

| | | | | |
|---|---|---|---|---|
| 5,808,654 | A | 9/1998 | Loos | 347/215 |
| 5,878,530 | A | 3/1999 | Eccleston et al. | 49/139 |
| 5,881,497 | A | 3/1999 | Borgardt | 49/139 |
| 5,930,954 | A | 8/1999 | Hebda | 49/345 |
| 6,002,217 | A | 12/1999 | Stevens et al. | 318/9 |
| 6,634,140 | B1 * | 10/2003 | Sellman | 49/340 |
| 2005/0091928 | A1 * | 5/2005 | Okulov et al. | 49/341 |

FOREIGN PATENT DOCUMENTS

| | | |
|---|---|---|
| FR | 2 508 530 | 12/1982 |
| JP | 90431 | 4/2001 |

* cited by examiner

AUTOMATIC DOOR OPENER WITH MAGNETIC CLUTCH

CROSS-REFERENCE TO RELATED APPLICATIONS

This application is a continuation-in-part of application Ser. No. 09/952,225, now U.S. Pat. No. 6,634,140, filed Sep. 13, 2001, which claims the benefit of U.S. provisional patent application Ser. No. 60/232,296, filed Sep. 13, 2000, all of which is incorporated herein by reference.

STATEMENT REGARDING FEDERALLY SPONSORED RESEARCH OR DEVELOPMENT

Not Applicable.

BACKGROUND OF THE INVENTION

1. Field of the Invention

The present invention relates generally to automatic side hinge door openers and, more particularly, relates to clutching and braking systems for use in conjunction with automatic door openers suitable for both original installation and easy retrofit onto standard side hinge doors.

2. Related Art

U.S. Pat. No. 5,878,530 to Eccleston et al, dated Mar. 9, 1999 and entitled "Remotely Controllable Automatic Door Operator Permitting Active And Passive Door Operation", discloses a remotely controllable automatic door opener for a side-hinged door. The opener comprises an electronically operated clutch in the gear train between the motor shaft and the opener arm drive shaft (output shaft). An electronic control unit comprising adjustable timers is employed to govern the opening and closing of the door.

U.S. Pat. No. 5,881,497 to Borgardt, dated Mar. 16, 1999 and entitled "Automatic Door Opener Adaptable For Manual Doors", discloses an automatic door opener that employs a slip clutch in the drive train between the motor and the output shaft.

U.S. Pat. No. 6,002,217 to Stevens et al, dated Dec. 14, 1999 and entitled "Door Operating System", discloses a door operating system that employs a dual position feedback system that can help prevent overtravelling of the door when it is being closed.

Other automatic door openers are directed towards opening of garage doors by means of drive chains or worm gears. While such door openers typically have some form of clutch mechanism, the weight of the garage door and the necessity that the garage door be raised vertically on rails require a slip clutch of great torsional capacity and some switching mechanism to stop the motor or interrupt the drive train when the door encounters an obstacle. In such garage door openers, the driven clutch mechanism is a shaft or gear engaging a travel nut or chain.

For example, U.S. Pat. No. 4,334,161 to Carli, dated Jun. 8, 1982 and entitled "Centrifugal Switch And Motor Control", discloses a friction clutch which is best seen in FIG. 1 and is described in column 2, line 62 through column 3, line 5. The friction clutch includes a circular drive member 27, a driven member 28 and a clutch facing 33 located therebetween. The clutch facing 33 is washer-shaped and has apertures that are slidably received on bosses 34 located on the driven member 28. Another washer-shaped component, hard metal disc 35, is secured by staking 36 to the circular drive member 27 and frictionally co-acts with the clutch facing 33. Tension on the driven member 28 is varied by tightening or loosening a nut 42 which maintains a spring 43 adjacent to the driven member. In operation, the door will move under normal operating conditions but may slip upon a definite overload. For example, should the door strike some obstacle or reach the up or down travel limits, the driven member 28 will stop and, in turn, the friction clutch will slip. When the clutch slips, a centrifugal switch mechanism 47 located on the driven member 28 closes, thereby shutting down the motor. Driven member 28 is connected to output shaft 40 which engages partial nut 45 to pull the weight of garage door 13 up track 14. In this arrangement, the clutch (un-numbered) is not by itself a sufficient safety mechanism should the door strike an obstacle such as a human being, thus necessitating centrifugal switch mechanism 47.

U.S. Pat. No. 3,955,661 to Popper et al, dated May 11, 1976 and entitled "Apparatus For Opening And Closing Door Members And The Like", discloses an apparatus for opening and closing doors including a ball drive assembly 56. The ball drive assembly 56 provides a driving connection between the driver shaft 50 and a driven shaft 58 such that the driven shaft 58 is rotatably driven at a predetermined reduced rate of speed compared to the speed of the driver shaft 50. A torque control 90 (best seen in FIG. 3) is provided to sense an obstruction in the path of the door member 14 and to send a stop signal to the motor control 48 via signal path 92. As drive chain 16 must vertically raise door member 14, ball drive assembly 56 provides a substantially increased internal friction as compared to the usual coupling devices such as pulley-belt drives or the like, thereby increasing the amount of force which must be manually applied to the door member 14 to move the door member 14 from a stopped or parked position (column 15, lines 17-28). Popper et al emphasize that the ball drive assembly 56 allows for substantially weaker torque control springs 206 and 210, and thus a more sensitive torque control 90. Torque control 90 shuts off the motor in response to the door member 14 being unable to move.

U.S. Pat. No. 5,222,327 to Fellows et al, dated Jun. 29, 1993 and entitled "Side Mount Garage Door Operator", discloses a side mount garage door opener including a means 17 for selectively connecting and disconnecting the drive shaft 14 with the door opening and closing mechanism 16. A clutch 22 is interposed between the drive shaft 14 and mechanism 16 and is manually operable for disengaging the drive motor from the garage door via a selector member 23 in the absence of electrical power. As illustrated in FIG. 3A, the clutch is shown in the engaged position but may be moved to the disengaged position as illustrated in FIG. 3 via movement of the selector member 23.

U.S. Pat. No. 3,719,005 to Carli, dated Mar. 6, 1973 and entitled "Door Operator Reversing Control", discloses a door operator having a friction clutch (un-numbered) and a one-way clutch 70. The friction clutch is similar to the one described above with respect to the aforementioned U.S. Pat. No. 4,334,161, and includes a clutch plate 24 and clutch disc 25 carrying a clutch lining 26 which frictionally cooperates with the clutch plate 24. The one-way clutch 70 is provided for moving a torque switch means 48 in one particular direction. A torque weight 71 is slidably mounted in an eccentric aperture 72 in a hub bracket 34 and functions, when the motor is reversed, to drive an inner cylindrical surface 79 of a drive disc 45 to establish a particular position of the torque switch means 48. The torque switch means 48 is moved in the opposite direction by a gravity-actuated weight 68. As in U.S. Pat. No. 4,334,161, worm 17 rotates to raise garage door 12.

U.S. Pat. No. 3,059,485 to Bohlman et al, dated Oct. 23, 1962 and entitled "Electro-Mechanical Door Opening And Closing Mechanism", discloses a garage door opener as illustrated in FIGS. 1 and 3, having clutch plates 51 and 60 disposed on each side of one wheel 55. Friction plates 65 convey torque to clutch plates 51 and 60 from one wheel 55, which in turn meshes with worm 77 (FIG. 4) situated on shaft 78 of motor 79. Driven shaft 24 is attached to clutch plates 51 and 60 and in turn rotates drum 30 having two runs of cable (un-numbered) which raise the garage door 46.

U.S. Pat. No. 4,852,706 to Pietrzak et al, dated Aug. 1, 1989 and entitled "Gate Operator", discloses a gate operator including, as illustrated in FIGS. 3, and 5, a clutch assembly 32, a clutch operator member assembly 50 and a clamp head 52. The clutch assembly 32 includes worm wheel 30 and floating pressure plates 34, which drive pressure plates 36 and friction discs 38 and thus drive sprocket 18. Clutch operator member assembly 50 includes Bellville washers 49, collar 58, needle bearing 60 and thrust washer 62. Clamp head 52 is operated by a lever 54 controlled in turn by a screw 70. In operation, the clamp head 52 functions to engage the clutch operator member assembly 50 for tensioning the clutch assembly 32. For example, when it is desired to tension the clutch to increase the load at which the clutch will slip, screw 70 is adjusted whereby clamp head 52 is pivoted causing thrust washer 62 to apply pressure to collar 58. This pressure causes Bellville washers 49 to apply pressure between the various plates of the clutch assembly 32. The gate operator pulls chain 86 to open and close the gate. Clutch operator member assembly 50 may be used to manually engage and disengage clutch assembly 32.

Known swing door operators usually have a type of door closer which automatically closes the door in a power failure. Prior art door openers also include those which are movable only when energized. These devices suffer from the drawback that upon loss of power the door is not easily movable, creating a hazard in the event of a fire. Some require sensors mounted in the motor housing or drive shaft to sense stoppage of the doors by an obstacle, and to disengage the clutch or stop the motor so as to prevent damage to the device or obstacle. Some have a clutch mechanism which must be operated manually.

Accordingly, it is desired to provide a door opener which may open a conventional side hinge door. It is also desired to provide a door opener which allows the door to stop when an obstacle is encountered, without the use of expensive, unreliable sensors, switches, torque controls and the like. It is also desirable to provide an automatic door opener that is easy to retrofit to existing doors and that provides an easily adjusted range of motion.

SUMMARY OF THE INVENTION

The present invention relates to a motorized door opener mechanism comprising a motor having a drive shaft, the drive shaft having an axis of rotation, an opener arm comprising an opener hub rotatably mounted on the drive shaft, a drive plate fixedly mounted on the drive shaft for rotation therewith, the drive plate comprising a magnetically attractable material, and an electromagnet positioned to engage the opener hub with the drive plate. The mechanism may optionally comprise a drag brake.

According to one aspect of the invention, the electromagnet may comprise a coil mounted on the opener hub and may engage a surface of the drive plate that is substantially perpendicular to the axis of rotation of the drive shaft.

This invention also relates to a self-contained clutch mounted on a rotatable member having a hub. The clutch comprises a clutch hub comprising an annular drive plate and a clutch post of reduced diameter relative to the drive plate, a hub of the rotatable member mounted on the clutch post, pressure means for generating friction to engage the rotatable member with the drive plate for rotation therewith, and a retaining cap to secure at least the hub of the rotatable member and the pressure means on the clutch post.

According to one aspect of this invention, the pressure means may comprise an electromagnet or a spring.

Optionally, the clutch may comprise at least one friction disc on the clutch post.

In another embodiment, this invention may provide a door opener mechanism comprising a motor having a drive shaft and a stationary surface, an opener arm having an opener hub, a self-contained clutch mounted on the drive shaft and comprising a clutch hub fixedly mounted on the drive shaft and comprising an annular drive plate and a clutch post of reduced diameter relative to the drive plate. The opener hub may be mounted on the clutch post. There may be pressure means mounted on the clutch post for pressing the opener hub towards the drive plate to generate friction to engage the opener arm with the drive plate for rotation therewith. There may also be a retaining cap to secure at least the opener hub and the pressure means on the clutch post and a drag brake on the drive shaft connected to the clutch.

The drag brake may comprise a brake plate rotatably mounted on the drive shaft and connected to the drive plate and a spring positioned to generate friction between the brake plate and the stationary surface.

DETAILED DESCRIPTION OF THE INVENTION AND PREFERRED EMBODIMENTS THEREOF

The present invention provides an automatic door opener for side hinged doors. The invention provides a motor connected via a clutch to swing an opener arm which in turn swings the door. The opener arm is mounted on an output shaft that directly drives the arm. According to one aspect of this invention, the clutch is mounted on the output shaft. According to another, separate aspect of this invention, the clutch and the hub of the opener arm are coaxially mounted on the drive shaft of the motor, i.e., the drive shaft of the motor serves as, or is at least coaxial with, the output shaft that drives the opener arm. This is in contrast to prior art designs in which slip clutches are mounted on intermediary gears in the drive train. Optionally, the clutch has a "self-contained" configuration when mounted on the opener arm so that it can easily be mounted on a drive shaft without affecting the slip characteristics. Also, the clutch may comprise an electromagnetic clutch.

Figure 1:
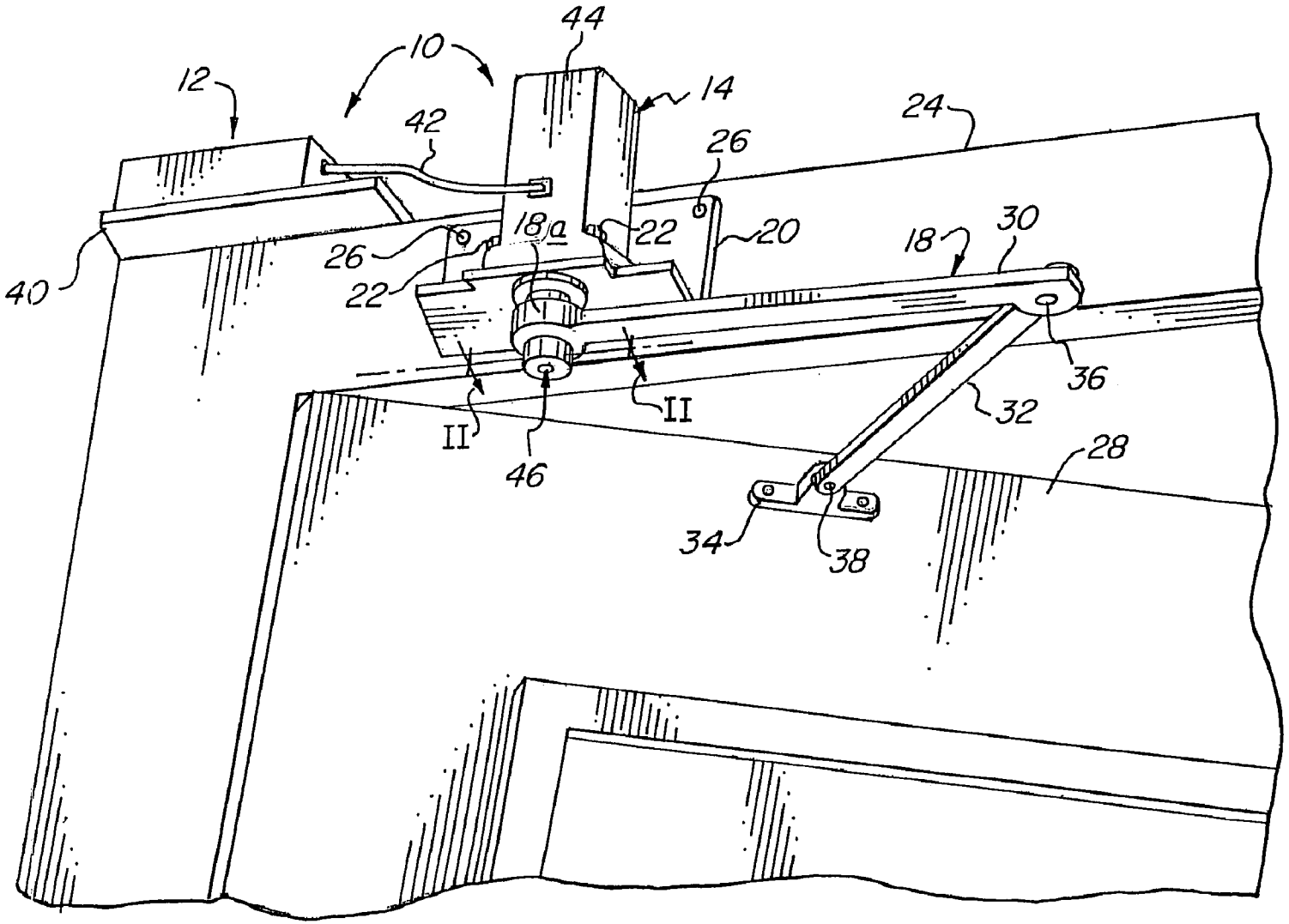
FIG. 1 is a perspective view of an automatic door opener mounted to a door frame and having its opener arm connected to a door in accordance with a first embodiment of the present invention.

Placement of the clutch on the output shaft constitutes a novel configuration (which may be referred to as a "direct-acting clutch") and it provides significant, previously unrecognized advantages over the placement of the clutch in other locations in the drive train. Specifically, by employing a direct-acting clutch, the overall construction of the opener mechanism can be simplified by the elimination of an intermediary gear in the drive train on which the clutch is mounted. Furthermore, when slippage occurs, it is generally at a much slower speed when the clutch is on the output shaft than when it is on an intermediary gear. As a result of the slower slip, the clutch lasts longer and has greater stability, lower heat build-up and better-controlled mechanical stress than would be experienced at a different location in the drive train. By mounting the clutch and the opener arm on the motor drive shaft, still further advantages are gained. These include a simplified design due to the elimination of any transfer or reduction gears between the motor drive shaft and the output shaft, increased ease of assembly because the clutch need not be built into a gear box comprising the intermediary gears and, in the case of a slip clutch, more uniform performance because the clutch is not exposed to the lubricants that are used with intermediary gear systems as it would be if it were situated in the gear box as shown, e.g., in U.S. Pat. No. 5,881,497 (FIG. 1). In addition, the elimination of the intermediary gear system means that torque is transferred more efficiently from the motor to the opener arm. Therefore, the torque rating of the motor can be more accurately balanced against the slip setting of the clutch. The clutch employed on the output shaft of the opener according to this invention may either be a friction or "slip" clutch (one embodiment of which is described herein with reference to FIGS. 1-3) or an electromagnetic clutch (two embodiments of which are described herein with reference to FIGS. 4 and 5, respectively).

Finally, the clutch and motor employed in a door opener according to this invention is chosen so that the door will not impose a large potentially injurious force on an obstacle (such as a person) that blocks the motion of the door and so that a person can easily back-drive the door against the impetus of the motor if necessary.

The present invention also provides improvements to motorized door openers that comprise a motor having a drive shaft, an opener arm mounted on an output shaft and a clutch in the drive train of the opener. One improvement of this invention comprises that the clutch is mounted on the output shaft. Optionally, the opener arm may be mounted on the drive shaft of the motor, whereby the drive shaft comprises the output shaft. The clutch may be either a slip clutch or an electromagnetic clutch.

Another aspect of this invention relates to an improvement to a door opener mechanism comprising a pivoting opener arm and a motor having a drive shaft, the improvement comprising that the opener arm is mounted on the drive shaft.

In a particular embodiment, the invention provides an automatic door opener for opening or closing a side-hinged door in a frame, comprising a shaft, a motor on the door or on the frame that drives the shaft, a slip clutch disposed upon the shaft, and an opener arm connected to the other of such door or frame, the opener arm having an opener hub disposed upon the slip clutch and in frictional engagement therewith. The frictional engagement is strong enough so that, when the motor drives the shaft, the slip clutch impels the shaft and opener hub to rotate together to cause motion of such door, but the frictional engagement is weak enough that, should the motion of such door be impeded by an obstacle, the slip clutch allows the shaft and opener hub to rotate relative to one another, without the use of sensors, switches, torque controls and the like.

One aspect of the invention is to provide an automatic door opener comprising a drag brake connected to the slip clutch, wherein the drag exerted by the drag brake is sufficient to prevent motion of the slip clutch when the motor does not drive the shaft.

Another aspect of the invention is to provide an automatic door opener wherein the slip clutch comprises a clutch hub affixed to the shaft, a bearing surface upon which the opener hub is disposed, first and second friction discs disposed upon the clutch hub on opposing sides of the opener hub, and a first spring disposed against the first friction disc so as to urge the first friction disc into contact with the opener hub.

A further aspect of the invention is to provide an automatic door opener further comprising a controller electrically connected to the motor and a door position sensor electrically connected to the controller, the controller being responsive to the door position sensor to activate and deactivate the motor as appropriate.

A still further aspect of the invention is to provide an automatic door opener wherein, when the motor and electromagnetic drag brake are not activated, the drag of the motor upon the shaft is sufficient to prevent motion of the door.

A still further aspect of the invention is to provide an automatic door opener which may comprise a controller electrically connected to a motor. The controller may be responsive to a signal to activate the motor further, including a signal from a hand-held remote control.

Another aspect of the invention is to provide an automatic door opener which may comprise timers that control the length of time during which the motor is activated to open the door, inactivated while the door is open and activated to close the door.

Yet another aspect of the invention is to provide an automatic door opener that, in the event of a power outage, allows users to open and close the door manually.

Thus, an automatic door opener is provided which eliminates the need for sensors, switches, and the like disposed within the motor housing for preventing damage to the motor in the event of the door engaging an obstacle or obstruction. As used herein, an obstacle may include an article that is inadvertently left in a doorway or a person in the way of the door. In either case, motion of the door will be stopped (or may even be reversed by hand) while the motor continues to run, without causing damage thereto.

Previous designs utilizing rotating shafts and worm drives, partial nuts or ball screws suffer from various comparative disadvantages. Such designs are more suited to the high torque requirements of lifting garage doors vertically and are less sensitive to impediments in their path necessitating control means (discussed in reference to the prior art above) to sense blockage of the door and stop the motor.

Known designs were not back-driven, meaning that the door could not be driven backwards against the motor independently of the motion of the drive shaft. The present design eliminates such mechanical or electronic control means, is well adapted to the side hinge doors of the typical residence or business, may be easily retrofit to such a door and may be easily back-driven. This allows an individual having a handicap rendering opening and closing of doors a challenge to more easily retrofit their existing domicile or business.

FIG. 1 shows a first preferred embodiment of a door opener 10 in accordance with the present invention. The door opener 10 comprises a controller 12, a motor 14, a slip clutch 46 and an opener arm 18. The door opener 10 is mounted to a mounting bracket 20 via fasteners 22 and, in turn, to a door frame 24 by fasteners 26. Alternatively, the motor and bracket may be mounted on the door and the opener arm mounted to the door frame.

The opener arm 18 is illustrated as being connected to a hinged door 28. The opener arm 18 may be composed of a metallic substance such as steel and preferably includes a first arm 30, a second arm 32 and a bracket 34. Hinge pins 36, 38 are provided for articulated movement of the first arm 30, the second arm 32 and the bracket 34 during opening and closing of the hinged door 28. Opener arm 18 further includes an opener hub 18*a* being an integral part of the first arm 30. Opener arm 18 is mounted on drive shaft 50, which extends from motor 14 and which therefore serves as the output shaft of the opener mechanism. Drive shaft 50 inherently has a longitudinal axis about which it rotates under the force of the motor 14.

The controller 12 is mounted on a block 40 and is connected to the motor 14 by a cable 42. The controller 12 energizes the motor 14 and is responsive to a sensor (not shown) for sensing a signal to open the door. The sensor may be a remote control infrared (IR) sensor, a remote control radio frequency (RF) sensor, a pressure sensor such as a button or footpad, or an optical sensor.

It will be understood that the electric motor 14 may be sized according to the dimensions and weight of the hinged door 28 and may include an optional gear train (not shown) disposed within a casing 44 of the motor 14. The gear train would provide a proper reduction (for example, 360:1) in output drive of the motor 14 necessary to move the hinged door 28 at an appropriate speed. Use of the gear train would also allow reduction in the size and power of the motor 14 necessary to permit manual movement of the door 28 even when the motor is deactivated or to permit a person to back-drive the door against the impetus of the motor, if needed.

Figure 2:
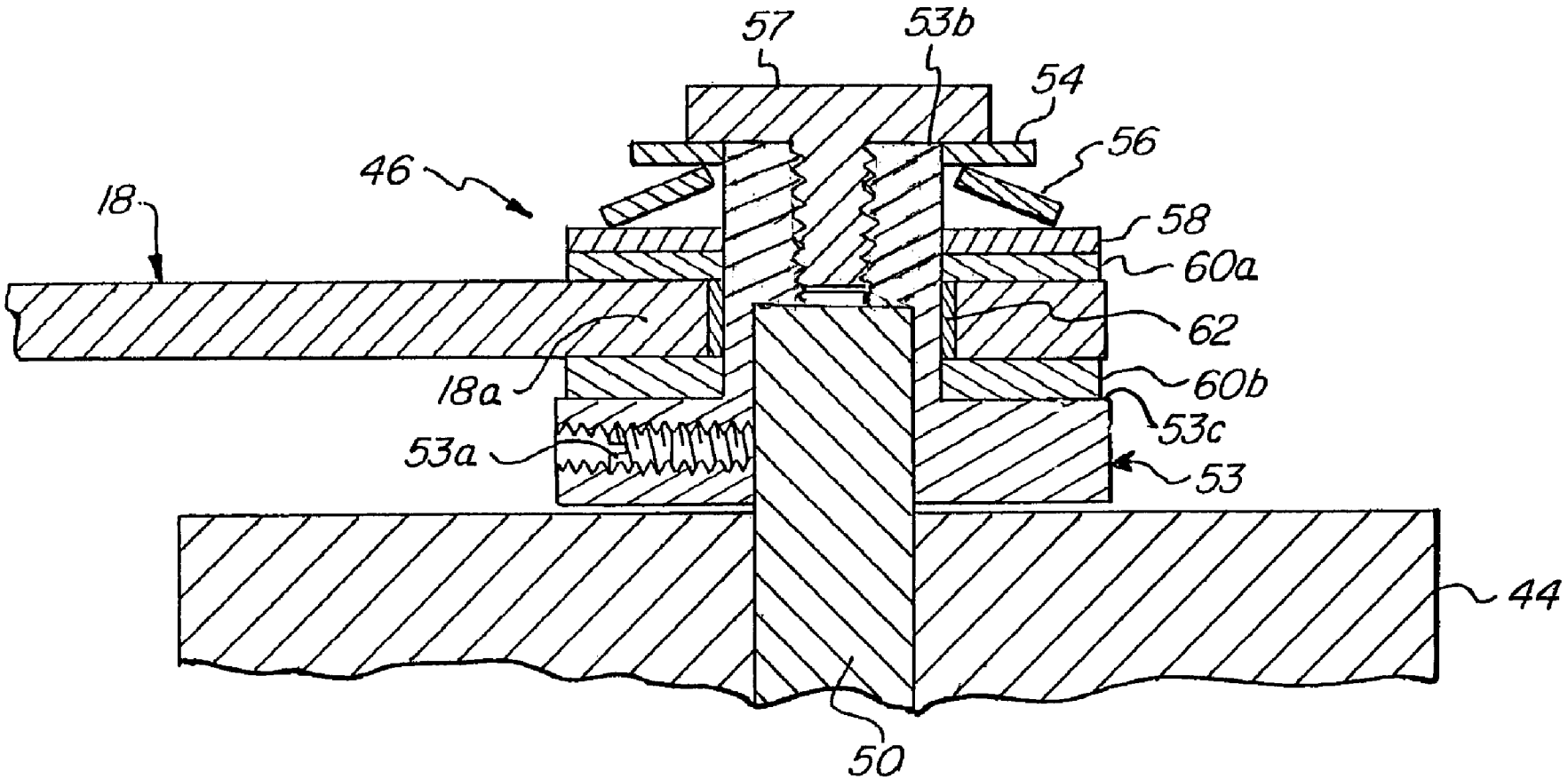
FIG. 2 is an enlarged cross-sectional view of the clutch assembly of the door opener of FIG. 1 taken along line II-II of FIG. 1.

Referring now to FIG. 2, the slip clutch 46 is disposed on a drive shaft 50. Slip clutch 46 includes a clutch hub 53 which comprises a drive plate 53*c* that is affixed to the drive shaft 50 via set screw 53*a*. Clutch hub 53 includes a clutch post of reduced diameter relative to drive plate 53*c*, such as clutch post 53*b*, and is configured internally to receive the end of the drive shaft 50. The clutch hub 53 may be composed of a strong and durable material such as metal. Clutch post 53*b* carries a spring 56, a drag washer 58, a pair of friction discs 60*a*, 60*b* and a thin sleeve-like bearing 62 upon which the opener hub 18*a* of opener arm 18 is disposed, all retained on the clutch hub by a retaining cap 57 that is secured to clutch post 53*b* by a screw thread engagement between them. An optional retaining ring 54 is provided as a washer between retaining cap 57 and spring 56. Optionally, friction disc 60*b* and thin bearing 62 may be formed together as an integrated body. Friction discs 60*a* and 60*b* have coefficients of friction which are selected in a manner well-known to those skilled in the art, to allow reliable rotation of opener hub 18*a* and yet allow opener hub 18*a* to move in relation to friction discs 60*a* and 60*b* when an obstacle is encountered or the door is back-driven.

The retaining ring 54 provides a stop for the spring 56, which serves the function of pressing the opener hub 18*a* towards the drive plate to generate friction to engage the opener hub with the drive plate for rotation therewith. Such engagement may be achieved by direct contact between them, or through contact with one or more intervening structures such as a friction disc. The spring 56 may comprise a Bellville washer and functions to press the drag washer 58 against the friction disc 60*a*. The opener hub 18*a* of opener arm 18 is sandwiched between the friction discs 60*a*, 60*b*. The friction discs 60*a* and 60*b* function to bear against the opener hub 18*a* to cause movement of the opener arm 18 coincidental to the motion of drive shaft 50. The friction discs 60*a*, 60*b* and drag washer 58 may be composed of metal or any other material that provides suitable friction and wear characteristics (a "frictional material") and, in addition, the material of the friction discs should be selected to minimize undesirable noise (squeal) and provide a maximum life span measured in cycles of duty. The choice of frictional materials to achieve the desired resistance can be made by one of ordinary skill in the art without undue experimentation. The thin bearing 62 is provided to allow relative movement of the opener arm 18 about the clutch hub 53 when the door 28 (FIG. 1) is stopped but the motor 14 (also FIG. 1) continues driving the drive shaft 50 and the clutch hub 53 secured thereto. The bearing 62 may be composed of, for example, a metallic or plastic substance.

An advantage of the clutch of FIG. 2 is that it can be fully assembled onto the driven member (e.g., the opener arm) separately from its installation onto the drive shaft, and installation on the drive shaft is easily accomplished because the clutch is configured to be easily fixedly secured onto the drive shaft, on which it remains while the clutch functions.

In the operation of clutch 46 or clutch 46', the spring 56 applies pressure to the drag washer 58 which, in combination with drive plate 53*c*, pressures the friction discs 60*a*, 60*b* adjacent the opener hub 18*a*, causing an operative connection (i.e., engagement) between the clutch hub 53 or 53' and the opener arm 18. Accordingly, when motor 14 (FIG. 1) is operating, drive shaft 50 or 50' will move the opener arm 18 and, in turn, the hinged door 28 (FIG. 1) will move. If the hinged door 28 hits an obstacle (not shown), for example, an article dropped on the floor in the path of the hinged door 28, the opener arm 18 will stop moving and the friction between the opener hub 18*a* and friction discs 60*a* and 60*b* will be overcome and opener hub 18*a* will ride on bearing 62 as shaft 50 or 50' and clutch hub 53 or 53' continue to move. By selecting friction discs 60*a* and 60*b* that have a coefficient of dynamic friction close to the value of the coefficient of static friction, excessive recoil and bounce can be eliminated when the door encounters an obstacle. In addition, in the event that power to the motor 14 is lost, the hinged door 28 may be hand-operated to overcome the friction between the friction discs 60*a*, 60*b* and the opener hub 18*a*.

During a typical cycle of use, controller 12 will energize motor 14 in response to a signal from a sensor (not shown) such as a pressure sensor, optical sensor or remote control. Motor 14 will rotate shaft 50 or 50' and slip clutch 46 or 46', thus causing opener arm 18 to open door 28 (FIG. 1). Controller 12 will stop motor 14 after a pre-programmed time. The length of time during which controller 12 energizes motor 14 for opening the door can be controlled with a simple timing circuit such as a resistance-capacitance (RC) circuit; by the use of a variable potentiometer, this circuit can be made easily adjustable, another assist to easy retrofitting.

In another embodiment of the invention, the operation of the motor for the opening of the door is responsive to a magnetic switch that indicates that the door has reached the desired open position. For example, a magnet may be mounted on the opener arm near the output shaft and the magnetic switch may be mounted on the motor bracket 34. The magnet and the switch are positioned so that when the opener arm has moved the door to the desired position, the magnet trips the switch. In response, the control circuitry for the door opener stops the motor. Thus, the period of time during which the motor turns to open the door (the "door open interval") lasts until the desired open position is attained. A timer circuit having an RC circuit that includes a variable potentiometer may be used to control the length of time the door remains open (the "hold open interval") in response to the needs of the user and other concerns such as security, environment and privacy. At the end of the hold open interval, the control circuitry may reverse the motor to close the door for an interval (the "door close interval") determined by another timer circuit (the "door close timer"). The door close timer may comprise an RC circuit with a fixed R value. If, during this cycle, door 28 hits an obstacle, opener hub 18*a* will break its frictional-engagement with the drive plate 53*c* and drag washer 58 (via friction discs 60*a* and 60*b*), thus allowing drive shaft 50' and clutch hub 53' to continue rotating and thus avoiding the possibility of damage to motor 14. The driven member of the invention, opener arm 18, thereafter rides on thin bearing 62 and friction discs 60*a* and 60*b* until the obstacle is removed or the timer stops the motor. Should an obstacle prevent the door from closing for the entire door close interval, it will remain open until the obstacle is removed and the open, hold and close processes are repeated.

In other embodiments, the use of variable potentiometers in the timer circuits that control the door open, hold open and door close intervals permits the user to adjust them as desired.

Figure 2A:
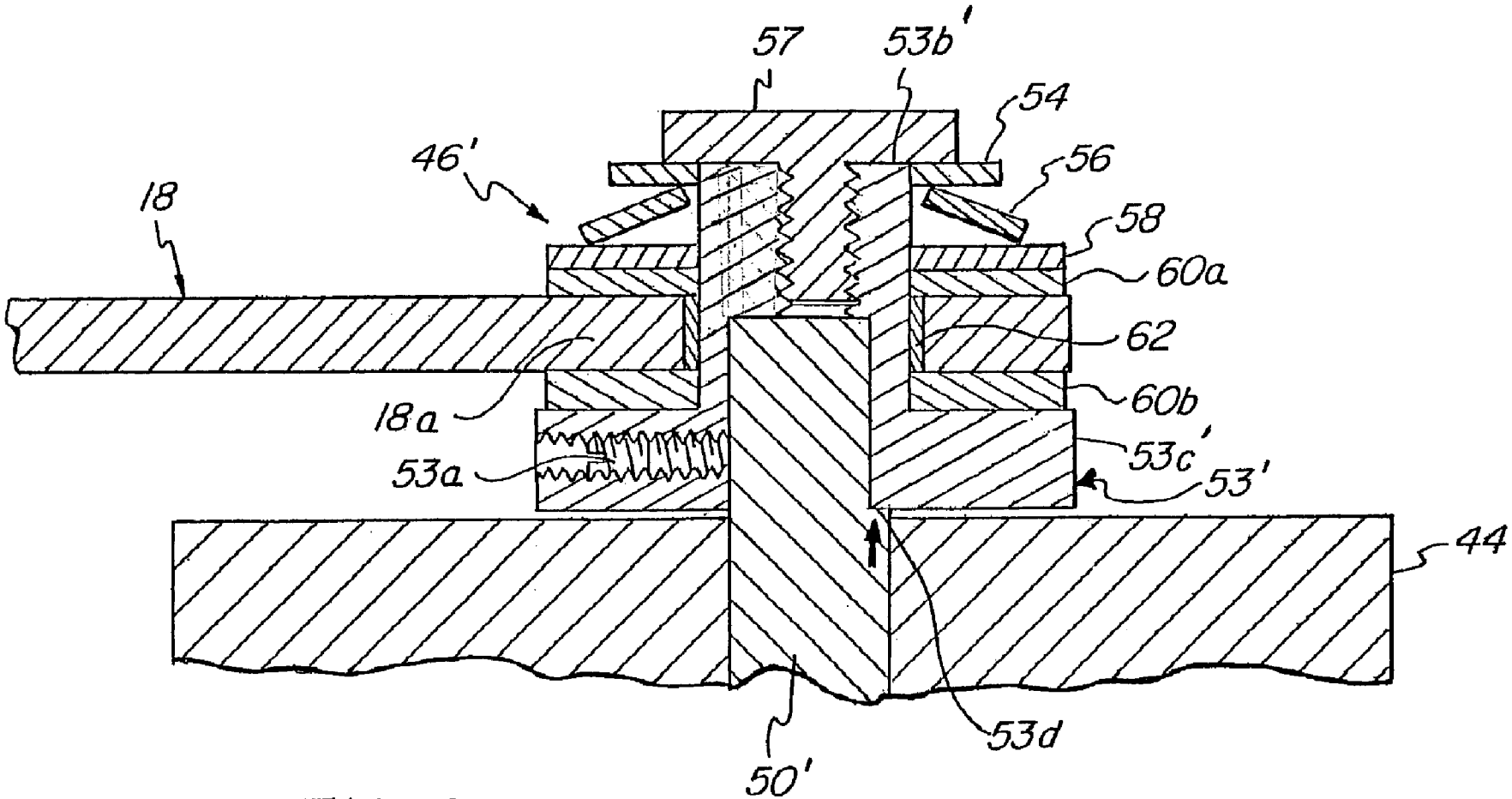
FIG. 2A is a view similar to FIG. 2 of a clutch assembly in which the clutch hub is keyed to the output shaft.

FIG. 2A illustrates a slip clutch 46' which is substantially similar in construction to slip clutch 46 and, in the Figure, structures that correspond to those in clutch 46 of FIG. 2 are identically numbered. In clutch 46', however, the clutch hub 53' is keyed to the drive shaft 50' by an axial flange 53*d*, which fixedly secures the clutch to the drive shaft for rotation therewith. The keying arrangement reduces the load carried by set screw 53*a*, or may obviate the need for set screw 53*a* completely. Clutch hub 18*a* is mounted on the clutch post 53*b*', and the operation of clutch 46' is otherwise the same as clutch 46.

Unlike prior art door openers, the invention does not require a torque sensor or other means for deactivating motor 14 when an obstacle is encountered. The invention also does not require a manual control for interrupting the drive train in order to open or close the door when motor 14 is not operating. The elimination of various electrical and mechanical components such as door position sensors, torque sensors, manual clutches, manual interruptions and so on make the device easier to manufacture and easier to install and use, with consequent savings of cost.

Figure 3:
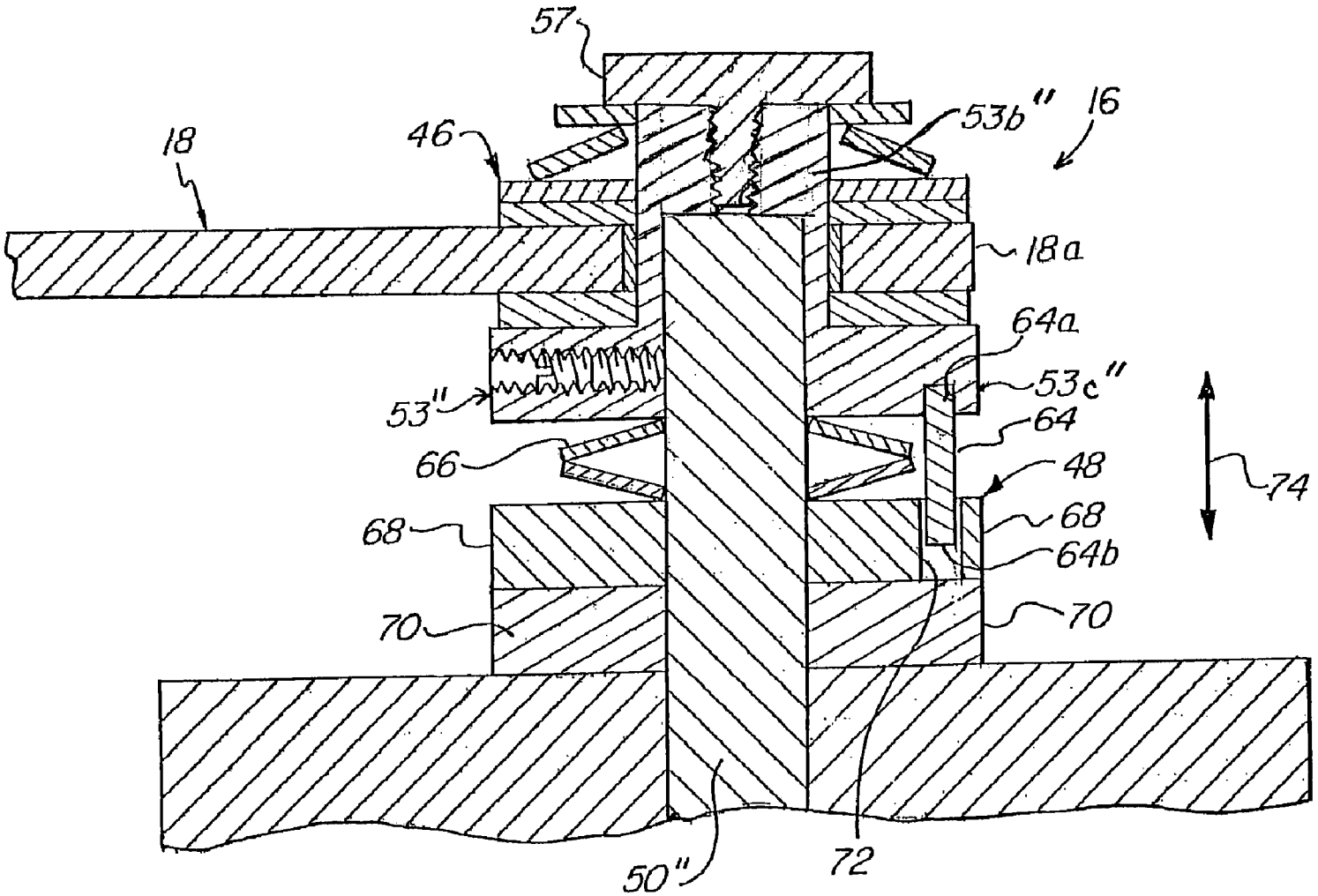
FIG. 3 is an enlarged cross-sectional view of a clutch and brake assembly of a second embodiment of the present invention.

FIG. 3 illustrates a clutch and brake assembly 16 comprising clutch 46" with a drag brake 48. Clutch 46" has substantially the same construction as clutch 46 of FIG. 2, except that clutch 46" comprises a clutch hub 53" which comprises a drive plate 53*c*" that is configured to receive a transfer pin 64.

A drag brake 48 is mounted on shaft 50" and is operatively connected to the clutch hub 53" via pin 64 and includes a spring 66, a brake plate 68 rotatably mounted on shaft 50", and a stationary surface 70. The pin 64 comprises a fixed end 64*a* and a free end 64*b*. The fixed end 64*a* is connected to the clutch hub 53" and the free end 64*b* is disposed within a cavity 72 of the brake plate 68. Accordingly, the pin 64 may translate a rotational force to the brake plate 68 as received from the clutch hub 53", yet allow linear movement of the brake plate 68 and clutch hub 53" in the directions of arrow 74.

Spring 66 is provided for pressing the brake plate 68 against the stationary surface 70, thus applying a drag force to the clutch hub 53" and in turn to the opener hub 18*a*. It will be appreciated that the tension and/or type of the spring 66 may be varied in order to provide a desired amount of drag on the movement of opener hub 18*a* (FIG. 2). The brake plate 68 may be composed of any suitably strong material such as a metallic composition.

In operation, the controller 12 (FIG. 1) will respond to a signal and open the hinged door 28, as described above in relation to the first embodiment, and the motor 14 will function to overcome the drag caused by the drag brake 48 until the hinged door 28 is fully open. Once the hinged door 28 is fully open, the motor 14 will be stopped and the drag brake 48 will maintain the hinged door 28 in the open position until the controller 12 reverses the direction of the motor 14 and closes the hinged door 28. Should there be a power loss to the motor 14, the drag brake 48 will retain the hinged door 28 in its position at the time of power loss unless it is hand-operated. As in the first embodiment, the clutch and brake assembly 16 are designed to permit the door to be moved by hand.

Figure 4:
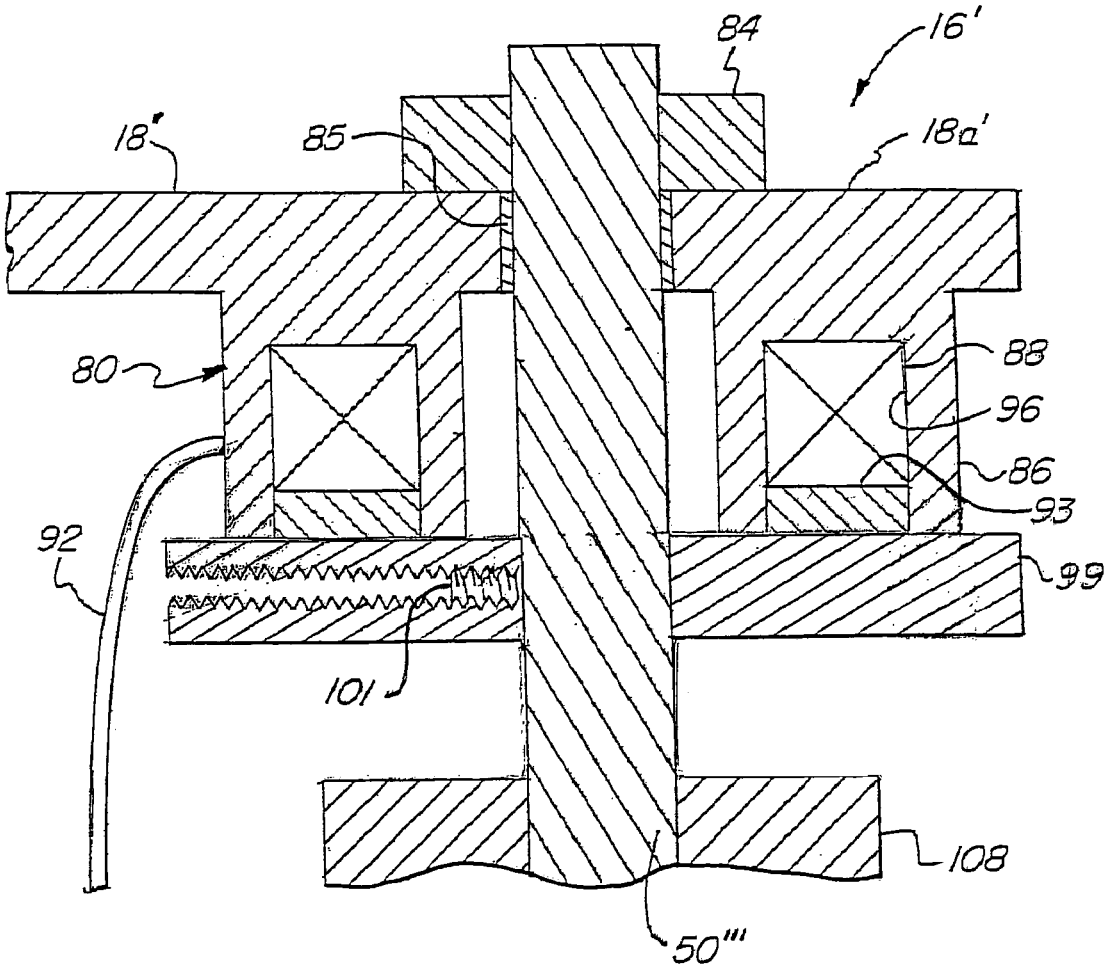
FIG. 4 is an enlarged cross-sectional view of a clutch assembly of a third embodiment of the present invention.

Another embodiment of a clutch assembly is illustrated in FIG. 4. Clutch assembly 16' comprises a drive plate 99 on shaft 50'" and an electromagnet 80. Electromagnet 80 is secured to opener hub 18*a*' and serves to engage the opener hub 18*a*' with the drive plate 99 by attracting them together to generate friction between them, either as a result of direct contact between drive plate 99 and opener hub 18*a*' or electromagnet 80, or as a result of friction with an intervening structure such as a friction disc, so that the opener hub 18*a*' rotates with the drive plate 99.

The electromagnet 80 comprises a field cup 86 that forms an annular receiving slot 96 within which an electromagnetic coil 88 is received. In the illustrated embodiment, field cup 86 is formed as an integral part of opener hub 18*a*' on opener arm 18', which is mounted on shaft 50'" via a bearing 85. (Alternatively, field cup 86 may be a discrete structure that is secured (e.g., bolted or welded) onto hub 18*a*'.) Bearing 85 allows rotation between opener hub 18*a*' and shaft 50'" and permits some axial motion of opener hub 18*a*' on the shaft, subject to the constraints of drive plate 99 and mounting cap 84. Electromagnet 80 is equipped with a frictional material 93 for contact with a mating surface of an adjacent structure. In this embodiment, frictional material 93 is disposed within field cup 86 but it protrudes therefrom sufficiently to bear on drive plate 99. Lead wires 92 extend from electromagnet 80 and are connected to a controller (not shown) to enable the controller to energize the coil. As shown, electromagnet 80 rests on drive plate 99, which is keyed to (i.e., fixedly mounted on) shaft 50'" by setscrew 101 so that drive plate 99 rotates with drive shaft 50'''. Drive plate 99 comprises a magnetically attractable material (e.g., it comprises iron).

Clutch assembly 16' is configured so that when coil 88 is not energized, electromagnet 80 bears on drive plate 99 via friction material 93 only under the influence of gravity, so that there is only a minimum of drag on the manual opening and closing of the door and insufficient friction for shaft 50''' to open the door should the motor operate inadvertently while the coil 88 is not energized. When coil 88 is energized via the controller, the magnetic attraction between electromagnet 80 and drive plate 99 generates friction at the mating surfaces of frictional material 93 and drive plate 99. The controller energizes the motor to rotate shaft 50''' while coil 88 is energized, and the friction between electromagnet 80 and drive plate 99 engages one with the other to transmit the rotation of shaft 50''' to opener hub 18*a*', thus rotating opener arm 18' to open or close the door (depending on the direction of rotation of shaft 50''').

Should the door engage an obstacle as it is being moved by clutch assembly 16', the clamping force provided by the electromagnet 80 between frictional material 93 and the drive plate 99 may be overcome by the motor, so that drive shaft 50''' may continue to rotate while opener arm 18' remains stationary on bearing 85. The frictional engagement between frictional material 93 and drive plate 99 may be nevertheless strong enough to overcome drag on the door induced by wind or weather-stripping. Conversely, in the event of seizure of motor 14, the frictional engagement between frictional material 93 and drive plate 99 may be overcome by the user and the door may be back-driven or otherwise hand-operated, even while subject to the effect of electromagnet 80.

During the course of repeated cycles of operation, shaft 50''' may precess. Drive plate 99, being fixed to the shaft 50'' via setscrew 101, precesses with shaft 50''', while electromagnet 80, being fixed to opener hub 18*a* and opener arm 18', does not, and thus lead wire 92 does not wrap around shaft 50''.

Figure 4A:
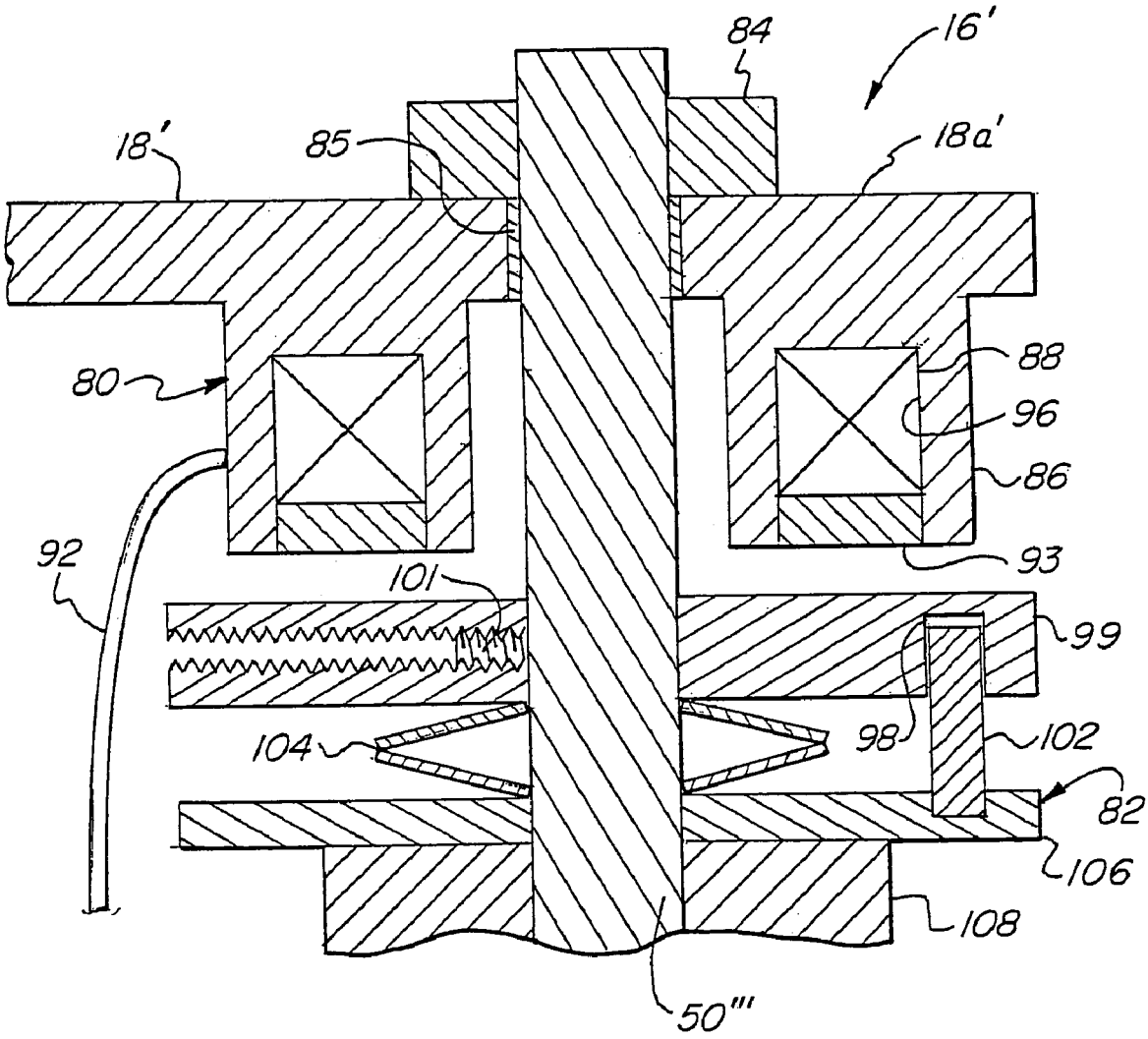
FIG. 4A is a cross-sectional view of an electromagnetic clutch assembly with a drag brake according to a fourth embodiment of this invention.

Optionally, clutch assembly 16' may be equipped with a drag brake as shown in FIG. 4A to provide a predetermined rotational drag in the event that coil 88 has been energized when the motor that drives shaft 50''' has not, leaving shaft 50''' freely rotatable (subject to the internal mechanical resistance of the inert driving motor). Drag brake 82 comprises a brake plate 106, a linking pin 102 and a drag spring 104. The brake plate 106 is freely rotatable about shaft 50''' and it is positioned to contact a stationary-plate 108 that may optionally be affixed to the motor housing (not shown). Drag spring 104 is an annular spring mounted on shaft 50''' between drive plate 99 and brake plate 106 or wherever else it may apply a constant, predetermined force on brake plate 106, which in turn bears on stationary plate 108 and generates friction between them. The rotation of shaft 50''' is subjected to the drag imposed by brake plate 106 because drive plate 99 is coupled to shaft 50''' via setscrew 101 and to brake plate 106 via a connector such as pin 102, which is mounted in bore 98 of drive plate 99 and a corresponding bore in brake plate 106. Should electromagnet 80 be energized when the motor is not energized, the clutch will be magnetically attracted to drive plate 99, the rotation of which will be subject to a drag imposed by drag brake 82. The door will therefore stay in a fixed position until a force sufficient to overcome the friction imposed by drag brake 82 (and any internal mechanical resistance of the inert driving motor) is applied to the door. Thus, the door can be held in a stationary position against minor dislocating forces until the motor is energized. On the other hand, drag spring 104 and brake plate 106 are chosen so that the motor that drives shaft 50''', when energized, has sufficient power to overcome the drag imposed by drag brake 82. Accordingly, when both electromagnet 80 and the motor driving shaft 50''' are energized, the clutch assembly 16' will function as described above in relation to FIG. 4.

Controller 12 may be actuated by, for example, footpads, however, it is preferable to use a remote control, keypad or similar device.

In the event of complete power loss, electromagnet 80 disengages opener arm 18 from drive plate 99, allowing the door to close under the impetus of a closer mechanism or spring hinge (as may be required for a fire door), or to move otherwise, with little or no extra drag in comparison to the same door prior to installation of the opener.

In a manner analogous to the non-magnetic slip clutches described above, the magnetic clutch embodiments of FIGS. 4 and 4A operate by the imposition of friction between parts that are disposed radially about the rotating drive shaft of the motor, with mating frictional surfaces that are essentially perpendicular to the drive shaft axis. The opener hub is also mounted directly on the drive shaft. Accordingly, there is no need for any intervening link between the drive shaft and the opener hub or the clutch mechanism.

Figure 4B:
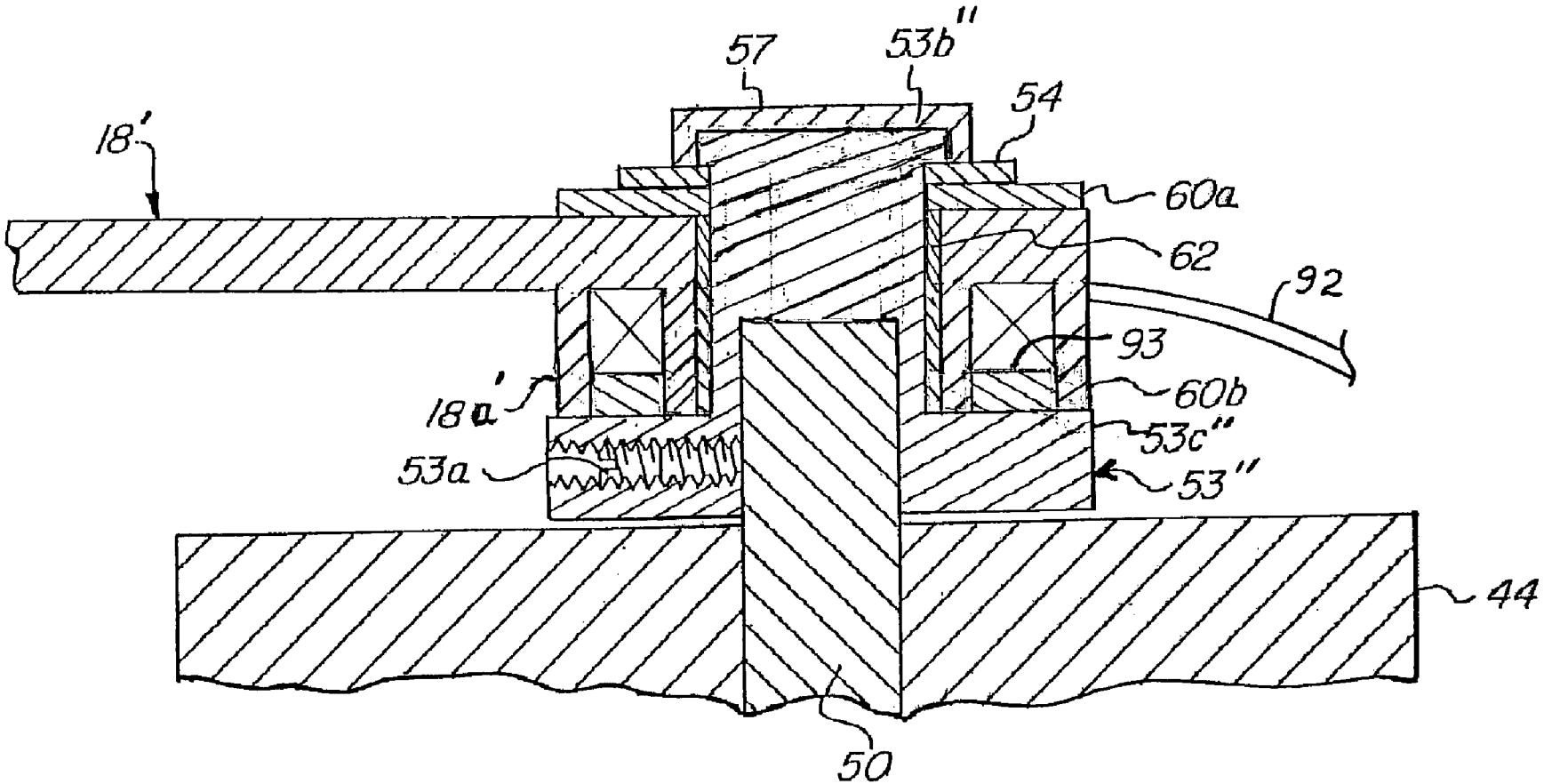
FIG. 4B is a cross-sectional view of a self-contained electromagnetic clutch according to a fifth embodiment of this invention.

Self-contained clutches similar to those of FIGS. 2, 2A and 3 can be assembled as electromagnetic clutches. For example, FIG. 4B shows a self-contained electromagnetic clutch in which an opener arm 18' carries an electromagnet comprising a field cup and coil therein, formed on the opener arm hub, just as in the embodiment of FIG. 4. Lead wires 92 connect the coil to a controller by which the user energizes the coil. The electromagnet serves as the pressure means in place of a spring or Bellville washer by providing magnetic attraction that draws together the opener hub 18*a*' and the drive plate 53*c*'' of clutch hub 53''. The clutch of FIG. 4B comprises an optional friction disc 60*a* between the opener arm hub 18*a*' and the retaining ring 54 on clutch post 53*b*''. Frictional material 93 is mounted in opener hub 18*a*' for contact with drive plate 53*c*''. As with the other self-contained clutches shown herein, the clutch of FIG. 4B is easily fixed onto a drive shaft 50 by means of a setscrew 53*a*, to assure rotation of drive plate 53*c*'' with drive shaft 50.

Figure 5:
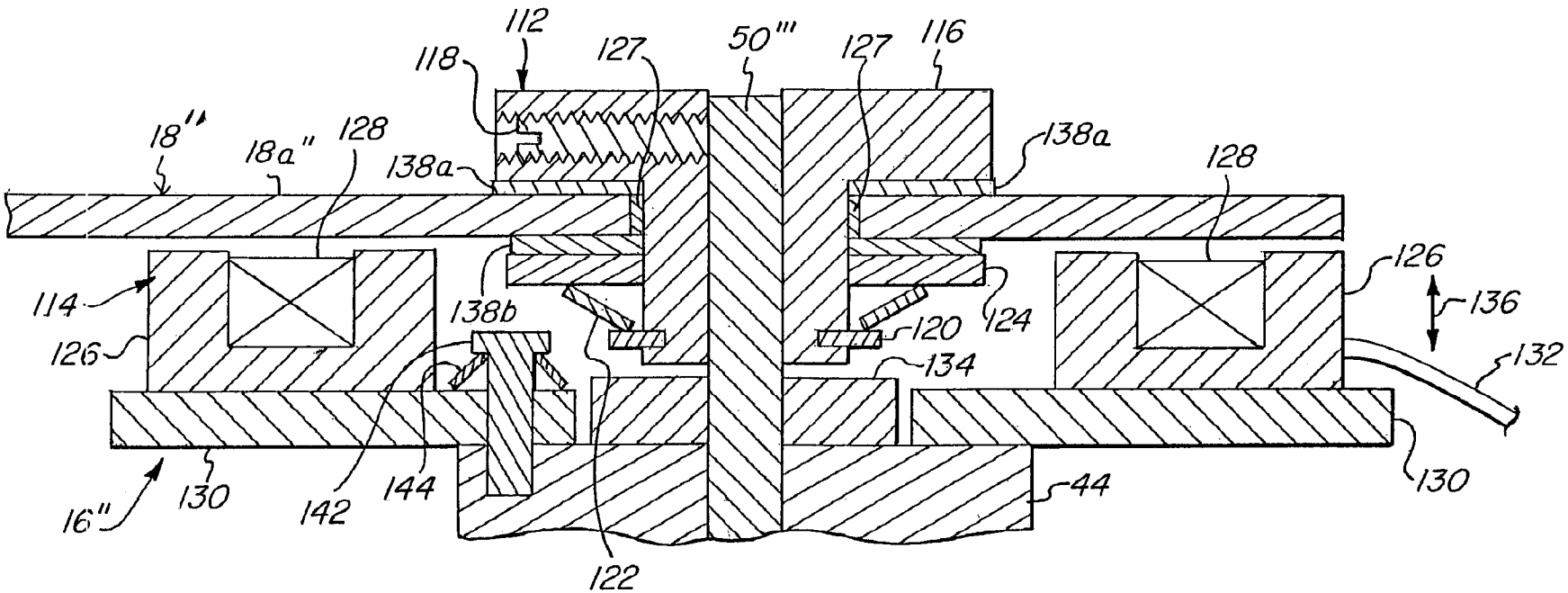
FIG. 5 is an enlarged cross-sectional view of a clutch and brake assembly of a sixth embodiment of the present invention.

An embodiment of a clutch and brake assembly according to this invention is generally illustrated at 16'' in FIG. 5. Slip clutch 112 is mounted on drive shaft 50''' so that it does not contact motor housing 44 or the optional stationary bump plate 134 thereon. Alternatively, slip clutch 112 may contact bump plate 134, either directly or via a bushing of frictional material between them. In this embodiment a slip clutch 112 is provided along with an optional electromagnetic brake 114. The slip clutch 112 is similar to the slip clutch 46 described above (see FIG. 2) although when compared to that previous embodiment, it can be seen that slip clutch 112 is mounted in the opposite orientation relative to the drive shaft 50'''. The slip clutch 112 includes a clutch hub 116 that is affixed to the drive shaft 50''' via a setscrew 118. The slip clutch 112 also includes a retaining ring 120, a spring 122, a drag washer 124, a pair of friction discs 138*a* and 138*b* and a thin bearing 127.

The electromagnetic brake 114 comprises a field cup 126, a coil 128, a mounting plate 130 and lead wires 132. The lead wires 132 may be connected to the controller 12 (FIG. 1) for control of the brake 114. The mounting plate 130 may be affixed to the motor casing 44 via any suitable means, for example, by means of a shoulder bolt 142, which has a spring-like wave washer 144 to allow motion of electromagnetic brake 114 as shown by arrow 136.

As previously described, spring 122 urges the friction discs 138*a*, and 138*b* against the opener hub 18*a*" with sufficient force that the drive shaft 50"' is operatively connected thereto. In use, electromagnetic brake 114 functions to clamp the opener hub 18*a*", which is composed at least partially of a magnetic substance, and thereby inhibits opener arm 18" from moving. In particular, the opener arm 18" is clamped adjacent to the field cup 126 as it moves along the direction of arrow 136.

When electromagnetic brake 114 is energized, it is attracted to opener hub 18*a*" with a force sufficient to drive it upward against the resistance of wave washer 144. Thus, electromagnetic brake 114 clamps onto opener hub 18*a*". The electromagnetic brake 114 may provide more braking power than the drag brakes previously described, and thus may hold a door in place even against substantial dislocating forces. Electromagnetic brake 114 can therefore be used to temporarily hold the door open against the impetus of a door closer mechanism or a gust of wind or the like, to permit a person to pass through the doorway. In alternative embodiments, circuitry can be provided in the motor to energize the motor in a way that makes it serve the braking function.

Upon de-energization of coil 128, wave washer 144 urges electromagnetic brake 114 away from opener hub 18*a*". Electromagnetic brake 114 is thus entirely disengaged, allowing the door to be back-driven or otherwise manually operated merely by overcoming the frictional engagement of friction discs 138*a* and 138*b* with opener hub 18*a*".

While the invention has been described in detail with respect to specific preferred embodiments thereof, numerous modifications to these specific embodiments will occur to those skilled in the art upon a reading and understanding of the foregoing description; such modifications are embraced within the scope of the present invention.

What is claimed is:

1. A motorized door opener mechanism comprising:

a motor having a drive shaft, the drive shaft having an axis of rotation;

an opener arm comprising an opener hub rotatably mounted on the drive shaft;

a drive plate fixedly mounted on the drive shaft for rotation therewith, the drive plate comprising a magnetically attractable material;

an electromagnet positioned to engage the opener hub with the drive plate; and a drag brake;

wherein the drag brake comprises:

a stationary plate;

a brake plate freely rotatable about the drive shaft and positioned to contact the stationary plate;

a link disposed between the brake plate and the drive plate to cause the brake plate to rotate with the drive plate; and a drag spring disposed to apply a constant force on the brake plate.

2. The mechanism of claim 1 wherein the electromagnet comprises a coil mounted on the opener hub and engages a surface of the drive plate that is substantially perpendicular to the axis of rotation of the drive shaft.

3. The mechanism of claim 1, wherein:

the drag spring is disposed between the drive plate and the brake plate.

4. The mechanism of claim 1, wherein:

the brake plate is in contact with the stationary plate to generate friction therebetween.

5. The mechanism of claim 1 wherein the brake plate is rotatably mounted on the drive shaft and connected to the drive plate, and a spring positioned to generate friction between the brake plate and the drive plate.

* * * * *